US009621981B2

(12) United States Patent
Zhang et al.

(10) Patent No.: US 9,621,981 B2
(45) Date of Patent: Apr. 11, 2017

(54) SPEAKER BOX

(71) Applicants: Fuhu Zhang, Shenzhen (CN); Chengliang Wang, Shenzhen (CN); Jiandong Tian, Shenzhen (CN)

(72) Inventors: Fuhu Zhang, Shenzhen (CN); Chengliang Wang, Shenzhen (CN); Jiandong Tian, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 14/594,294

(22) Filed: Jan. 12, 2015

(65) Prior Publication Data

US 2016/0127822 A1 May 5, 2016

(30) Foreign Application Priority Data

Nov. 5, 2014 (CN) ..... 2014 2 0656242 U

(51) Int. Cl.
*H04R 1/20* (2006.01)
*H04R 1/28* (2006.01)

(52) U.S. Cl.
CPC ..... *H04R 1/288* (2013.01)

(58) Field of Classification Search
CPC .. H04R 2499/11; H04R 1/403; H04R 1/2811; H04R 1/345; H04R 1/02; H04R 1/2803; H04R 1/2842; H04R 1/2819; H04R 1/2888; H04R 2201/021; H04R 2205/021; H04R 19/02; H04R 1/00; H04R 1/2834; H04R 1/2853; H04R 1/288
USPC ..... 381/162, 338, 345, 346, 351, 352, 354, 381/359; 181/284; 379/428.01; 455/569.1
See application file for complete search history.

(56) References Cited

U.S. PATENT DOCUMENTS

| | | | | |
|---|---|---|---|---|
| 5,793,000 A * | 8/1998 | Sabato | H04R 1/025 181/151 |
| 6,078,676 A * | 6/2000 | Takenaka | H04R 1/345 181/145 |
| 7,065,221 B1 * | 6/2006 | Tanaka | H04R 3/04 381/59 |
| 2007/0121986 A1 * | 5/2007 | Shim | H04R 1/1016 381/382 |
| 2014/0133684 A1 * | 5/2014 | Zha | H04R 1/021 381/345 |

* cited by examiner

*Primary Examiner* — Paul S Kim
*Assistant Examiner* — Norman Yu
(74) *Attorney, Agent, or Firm* — Na Xu; IPro, PLLC

(57) ABSTRACT

A speaker box is provided in the present disclosure. The speaker box includes a housing having a sound outlet, a top plate covering the housing, and a sound generator installed to the housing. A front sound chamber and a sound guide channel are formed between the housing and the top plate. The sound generator is configured for providing audible sound to the front sound chamber. The sound guide channel communicates with the front sound chamber, and is configured for guiding the audible sound to output from the sound outlet. An acoustic absorber is arranged within the sound guide channel.

11 Claims, 3 Drawing Sheets

SPEAKER BOX

FIELD OF THE DISCLOSURE

The present disclosure generally relates to vibrating acoustic technologies, and more particularly, to a speaker box for producing audible sound.

BACKGROUND

With development of mobile internet technologies, intelligent electronic devices (IEDs), such as smart phones and tablet personal computers, are used more and more widely. Multi-media such as music playing is one of the most popular functionalities of the intelligent electronic device, and a speaker box is normally employed in an intelligent electronic device to enable the intelligent electronic device to produce audible sound with better low frequency quality.

A typical speaker box uses a sound guide channel to guide the audible sound to transmit and output surrounding air; however, because a size of the speaker box is usually small, the sound guide channel inside the speaker box needs to be somewhat narrow. This brings serious intermediate frequency distortion to the audible sound, and lowers an output tone quality of speaker box in the electronic device.

Therefore, it is desired to provide a speaker box to overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and embodiments thereof.

Figure 1:
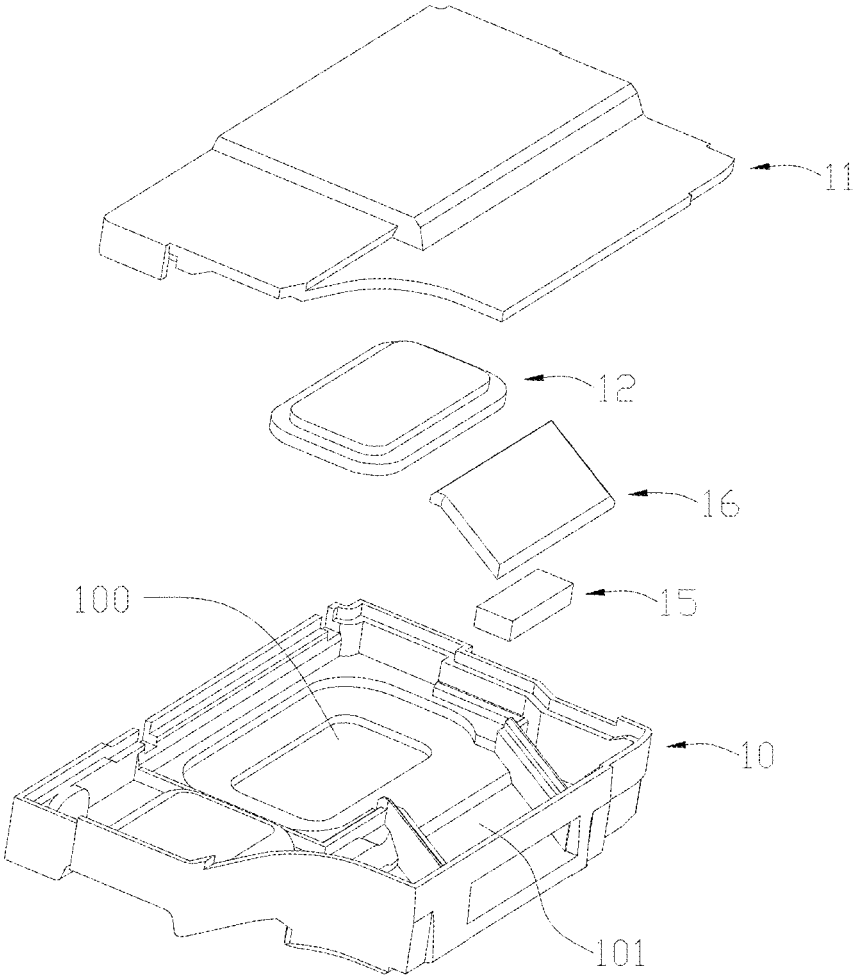
FIG. 1 is an exploded view of a speaker box according to an exemplary embodiment of the present disclosure.
Figure 2:
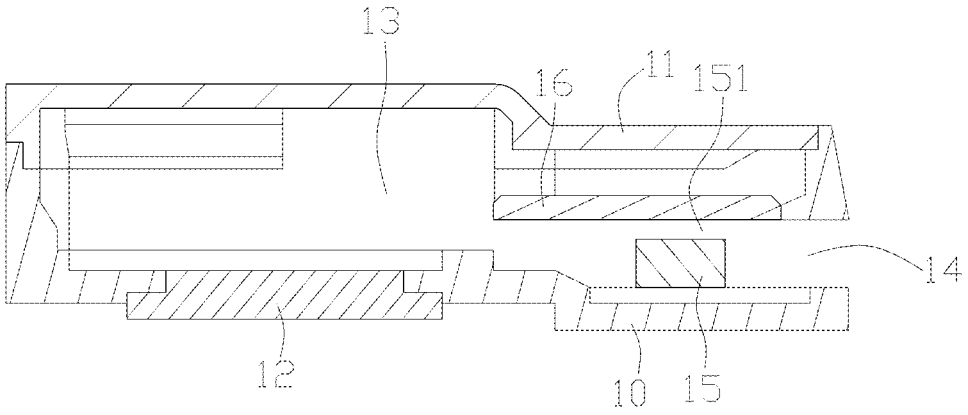
FIG. 2 is a cross-sectional view of the speaker box in FIG. 1.

Referring to FIG. 1 and FIG. 2, a speaker box 1 according to an exemplary embodiment of the present disclosure is shown. The speaker box 1 is applicable to an intelligent electronic device such as a smart phone, a tablet personal computer, or the like. The speaker box 1 includes a housing 10, a top plate 11 and a sound generator 12.

The housing 10 includes a bottom plate and a plurality of sidewalls; the sidewalls extend perpendicularly from the bottom plate. A receiving opening 100 and a recess 101 are respectively formed in the bottom plate, and one of the sidewalls of the housing 10, which is adjacent to the recess 101, is configured with a sound outlet.

The top plate 11 covers the housing 10 and is fixed to upper ends of the sidewalls. The top plate 11 and the housing 10 cooperatively define a hollow space therebetween. The hollow space includes a front sound chamber 13 and a sound guide channel 14. The receiving opening 100 of the bottom plate is formed under the front sound chamber 13, and the front sound chamber 13 communicates with the sound guide channel 14. The sound generator 12 is installed in the receiving opening 100, and faces the front sound chamber 13. With this configuration, the audible sound produced by the sound generator 12 can be transmitted to the front sound chamber 13, and then further transmitted to the sound guide channel 14.

In particular, two supporting ribs are respectively arranged at two opposite sides of the recess 101; and a cover plate 16, which is opposite to the recess 101 of the bottom plate, is placed on the supporting ribs in the housing 10. The cover plate 16, the recess 101 and the supporting ribs cooperatively define the sound guide channel 14.

Moreover, the sound guide channel 14 further communicates with the sound outlet in the sidewall. As such, the audible sound passing through the sound guide channel 14 can be further transmitted to surrounding air of the speaker box 1 via the sound outlet, and consequently, a user can hear the audible sound transmitted through the surrounding air.

In the present embodiment, to depress intermediate frequency distortion of the audible sound in the speaker box 1, an acoustic absorber 15 can be arranged within the sound guide channel 14, for example, the acoustic absorber 15 may be disposed on the recess 101 of the bottom plate, and face the sound outlet in the sidewall. The acoustic absorber 15 may for example be acoustic wool. Optionally, a height of the sound absorber 15 may be less than that of the sound guide channel 14, such that a gap 151 is formed between the sound absorber 15 and the cover plate 16. The gap 151 may further lower the intermediate frequency distortion of the audible sound in the speaker box 1.

Figure 3:
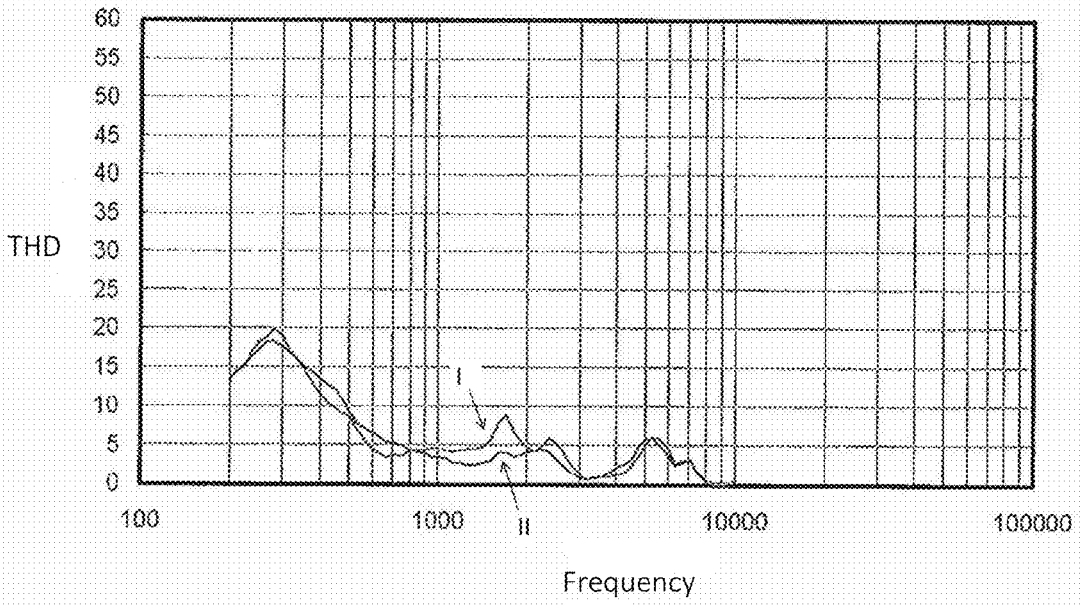
FIG. 3 illustrates a relationship between audio frequency and total harmonic distortion (THD) of audible sound in the speaker box in FIG. 1.

FIG. 3 illustrates a relationship between audio frequency and total harmonic distortion (THD) of the audible sound in the speaker box 1. In FIG. 3, curve I represents intermediate frequency distortion of the audible sound when no acoustic absorber is arranged within the sound guide channel 14 of the speaker box 1, and curve II represents intermediate frequency distortion of the audible sound when the acoustic absorber 15 is arranged within the sound guide channel 14 of the speaker box 1. From the illustration of FIG. 3, it can be found that the intermediate frequency distortion of the audible sound in the speaker box 1 is depressed when the acoustic absorber 15 is arranged within the sound guide channel 14.

In summary, in the speaker box 1 as provided in the present disclosure, the acoustic absorber 15 arranged within the sound guide channel 14 can depress the intermediate frequency distortion of the audible sound in the speaker box 1, therefore, the output tone quality of the speaker box 1 can be improved.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker box, comprising:

a housing comprising a sound outlet, a bottom plate having a recess, and two supporting ribs respectively arranged at two opposite sides of the recess;

a top plate covering the housing; and a sound generator installed to the housing;

wherein a front sound chamber and a sound guide channel are formed between the housing and the top plate, and a cover plate covering the sound guide channel, the sound generator is configured for providing audible sound to the front sound chamber; the cover plate is placed on the supporting ribs and opposite to the recess, wherein the cover plate, the recess and the supporting ribs cooperatively define the sound guide channel; the sound guide channel communicates with the front sound chamber and is configured for guiding the audible sound to output from the sound outlet; wherein an acoustic absorber is arranged within the sound guide channel and protrudes from the bottom plate; the acoustic absorber partially covers the bottom plate, and a height of the sound absorber is less than that of the sound guide channel such that a gap is formed between the sound absorber and the cover plate.

2. The speaker box of claim 1, wherein the acoustic absorber is acoustic wool.

3. The speaker box of claim 1, wherein the housing comprises a plurality of sidewall extending perpendicularly from the bottom plate, the sound outlet is formed at one of the sidewalls.

4. The speaker box of claim 3, wherein the bottom plate comprises a receiving opening; the sound generator is installed to the receiving opening, and faces the front sound chamber.

5. The speaker box of claim 4, wherein the sound guide channel is formed at the recess.

6. A speaker box, comprising:

a housing comprising a bottom plate having a recess, and two supporting ribs respectively arranged at two opposite sides of the recess;

a top plate covering the housing, the top plate and the housing cooperatively defining a hollow space comprising a front sound chamber and a sound guide channel;

a cover plate covering the sound guide channel; the cover plate being placed on the supporting ribs and opposite to the recess; the cover plate, the recess and the supporting ribs cooperatively defining the sound guide channel; and a sound generator for providing audible sound to the front sound chamber, the sound generator being installed to the housing and facing the front sound chamber;

wherein the sound guide channel communicates with the front sound chamber, and an acoustic absorber is arranged within the sound guide channel and protrudes from the bottom plate; the acoustic absorber partially covers the bottom plate, and a height of the sound absorber is less than that of the sound guide channel such that a gap is formed between the sound absorber and the cover plate.

7. The speaker box of claim 6, wherein the acoustic absorber is acoustic wool.

8. The speaker box of claim 6, wherein the housing comprises a plurality of sidewall extending perpendicularly from the bottom plate, a sound outlet communicating with the sound guide channel is formed at one of the sidewalls, and the sound guide channel is configured for guiding the audible sound from the front sound chamber to the sound outlet.

9. The speaker box of claim 8, wherein the bottom plate comprises a receiving opening; the sound generator is installed in the receiving opening.

10. The speaker box of claim 9, wherein the sound guide channel is formed at the recess.

11. A speaker box, comprising:

a housing including a sound outlet, a bottom plate having a recess, and two supporting ribs respectively arranged at two opposite sides of the recess;

a top plate covering the housing;

a sound generator accommodated in the housing for providing audible sound;

a front sound chamber formed between the housing and the top plate for receiving the audible sound;

a sound guide channel formed between the housing and the top plate, and communicated with the front sound chamber for guiding the audible sound to output via the sound outlet;

a cover plate covering the sound guide channel; the cover plate being placed on the supporting ribs and opposite to the recess; the cover plate, the recess and the supporting ribs cooperatively defining the sound guide channel;

an acoustic absorber arranged within the sound guide channel and protruding from the bottom plate toward the top cover for partially covering the bottom plate; wherein a height of the acoustic absorber is less than a height of the sound guide channel for accordingly forming a gap between the acoustic absorber and the cover plate such that the audible sound is transmitted through the gap and the acoustic absorber then outputted from the sound outlet.

* * * * *